US006691431B2

(12) United States Patent
Farrior

(10) Patent No.: US 6,691,431 B2
(45) Date of Patent: Feb. 17, 2004

(54) APPARATUS AND METHOD FOR AUGMENTING DANCER'S FOOT

(76) Inventor: Sylvia Ortiz Farrior, 7619 Saint George Blvd., Fishers, IN (US) 46038

( * ) Notice: Subject to any disclaimer, the term of this patent is extended or adjusted under 35 U.S.C. 154(b) by 0 days.

(21) Appl. No.: 09/929,093

(22) Filed: Aug. 14, 2001

(65) Prior Publication Data

US 2003/0033729 A1 Feb. 20, 2003

(51) Int. Cl.[7] ..... A43B 5/12

(52) U.S. Cl. ..... 36/8.3; 36/113; 36/71; D24/192

(58) Field of Search ..... 36/8.3, 71, 113, 36/132–136, 131, 72 R, 77 R, 96, 11; D24/190, 192; 2/22, 911

(56) References Cited

U.S. PATENT DOCUMENTS

| | | | | | |
|---|---|---|---|---|---|
| 147,698 | A | | 2/1874 | Smith | |
| 326,728 | A | * | 9/1885 | Georges | 36/71 |
| 374,106 | A | | 11/1887 | Winter | |
| 1,651,285 | A | * | 11/1927 | Levick, Jr. | 602/66 |
| 1,901,659 | A | | 3/1933 | Larack | |
| 2,090,573 | A | | 8/1937 | 'Alessandro | |
| 2,332,252 | A | * | 10/1943 | Payne | 36/106 |
| 4,756,026 | A | | 7/1988 | Pierce, Jr. | |
| 5,007,111 | A | | 4/1991 | Adams | |
| 5,035,069 | A | * | 7/1991 | Minden | 36/113 |
| 5,191,726 | A | * | 3/1993 | Vallee | 36/88 |
| 5,898,939 | A | | 5/1999 | Schramm | |
| D445,192 | S | * | 7/2001 | Rodgers | D24/192 |

* cited by examiner

*Primary Examiner*—Jila M. Mohandesi
(74) *Attorney, Agent, or Firm*—Woodard, Emhardt, Moriarty, McNett & Henry LLP

(57) ABSTRACT

An apparatus and method for improving the appearance of a dancer's feet. By attaching a pad that has a curved top surface to the top of a dancer's foot, the shape of the top of the dancer's foot is more aesthetically pleasing. Additionally, the arch on the bottom of the foot appears more marked. The present invention can be employed with a wide variety of dance shoes and outfits to improve the appearance of a dancer's feet. The pad is formed from a resilient and deformable material and is sized to substantially cover the top of the foot. The pad has an edge portion sized to be concealed under the border and ribbons of a dance shoe so that the existence of the pad cannot easily be detected. When worn, the shape and thickness of the pad augments the appearance of the top and bottom of the foot.

16 Claims, 19 Drawing Sheets

APPARATUS AND METHOD FOR AUGMENTING DANCER'S FOOT

FIELD OF THE INVENTION

The present invention relates generally to the dance arts and more particularly to improvements in the appearance of a dancer's foot.

BACKGROUND

In the dance arts such as ballet, modern dance, jazz and the like, the physical attributes of the dancer are of utmost importance. Desirable physical attributes of a dancer include a small to medium sized head, a long neck, proportionate torso, long legs which "turn out," and most importantly, beautiful feet. The single most defining characteristic of a beautiful foot for dance purposes is the shape and extent of the arch. A well defined arch is known in the art as a "banana foot," referring to a foot with a marked arch on the bottom of the foot and a complementary smooth radius shape to the top or instep of the foot. Such a foot thus resembles the shape of a banana.

Sadly, the opportunities for a dancer are often limited by the dancer's lack of the physical attributes just noted, especially in the area of the feet. For example, a dancer with exceptional dance abilities but who has relatively flat feet may be denied entrance to summer programs as a child, later be denied entrance into dance programs at universities, and ultimately be denied the opportunity to dance professionally. These opportunities are lost not because of the lack of dance ability, but rather because of a lack of an aesthetically pleasing foot.

U.S. Pat. No. 326,728 (J. J. Georges) discloses a pad attached to the top of the foot by straps for the purpose of giving a foot covered by a shoe a comely shape and preventing it from moving or sliding in a shoe or boot. The patent teaches that the shoe covers the pad. Similarly, U.S. Pat. No. 147,698 (J. B. Smith) and U.S. Pat. No. 374,106 (C. H. Winter) disclose pads to improve the form of the foot and to protect the foot from the laces of the shoe. In these patents, the shoe covers the pad and assists in holding same in place.

Other patents such as U.S. Pat. No. 1,901,658 (F. A. Larack) and U.S. Pat. No. 2,090,573 (F. D. 'Alessandro) address the discomfort a woman suffers in traditional high heeled shoes by providing cushioning pads or instep protectors that fit under the vamp portion of the high heeled shoe.

The prior art just noted teaches covering the foot with a traditional shoe or teaches relieving rubbing and irritation of the foot caused by the vamp of a high heeled shoe. However, the prior art above does not address improving the look of a substantially uncovered foot such as that of a dancer wearing a ballet slipper or pointe shoe. Further, quite unlike the shoes disclosed by the prior art just noted, a dance or "pointe shoe" conforms to the arch of the foot, thereby providing little no support to the dancer's arch and thus revealing the true shape of the bottom of the dancer's foot. If the dancer's foot be flat, a pointe shoe will reveal it. More specifically, every time a dancer's foot is off the floor, it is pointed, thereby revealing the arch, or lack thereof.

What is needed is a way to improve the look of a dancer's foot that is undetectable and that does not impede the dancer's ability to perform intricate dance movements.

SUMMARY OF THE INVENTION

The present invention is an apparatus and method for improving the appearance of a dancer's feet. By attaching a pad that has a curved top surface to the top of a dancer's foot, the shape of the top of the dancer's foot is improved. Additionally, the arch on the bottom of the foot appears more marked. The present invention can be employed with a wide variety of dance shoes and outfits to improve the appearance of a dancer's feet.

In one form thereof, the invention resides in the combination of a dance shoe and a pad that is attached to the dancer's foot. The dance shoe comprises a fabric material adapted to partially cover the foot of its wearer. A flexible sole is disposed on the bottom of the fabric and is adapted to conform to the shape of the arch of the foot. The fabric material terminates in a border which further defines an open top of the shoe and which is adapted to substantially expose the top or instep of the foot. The border also defines a vamp adapted to cover the toes. The pad is formed from a resilient and deformable material and is sized to substantially cover the top of the foot. The pad has an edge portion sized to be concealed under the border, whereby, when worn, the pad is substantially uncovered by the shoe and the shape and thickness of the pad augments the appearance of the top and bottom of the foot.

In a preferred form, the dance shoe further comprises a ribbon which is adapted to further conceal the edge of the pad. Ideally, the edge of the pad is either covered by the ribbon from the dance shoe or the border of the dance shoe, thereby being very difficult to detect and thus giving the foot a natural looking and aesthetically pleasing appearance. The curved appearance to the top of the foot is achieved by a pad whose top surface is curved, the pad tapering in thickness from its center to the edge.

More preferably, the pad can be made of foam or other suitable soft, resilient and lightweight material. This material is encased in cloth or fabric having a skin color. The pad includes a stretchable band attached thereto that is adapted to be placed around the foot and hold the pad in place.

In another form thereof, the present invention provides a method of wearing a dance outfit to augment the appearance of a dancer's foot. According to this method, a pad is attached to the top of the foot and thereby covers a portion of the top of the foot. A tight is donned over the pad, whereby the pad is concealed by the tight. Finally, a dance shoe having a substantially open top is worn over the tight, the pad being substantially or totally uncovered by the dance shoe. In this method, the top surface of the pad defines what appears to be the top profile of the dancer's foot and the pad thus enhances the appearance of the top and bottom of the dancer's foot.

More preferably, the method includes covering the side edges of the pad with the border of the shoe, the front edge of the pad with the vamp of the shoe, and the back edge of the pad with a ribbon of the shoe. In this manner, the edges of the pad are totally concealed from view and the pad is thus difficult to detect. Instead, the top of the dancer's foot appears as though it were more curved than it actually is.

One advantage of the present invention is that it improves the appearance of a dancer's foot yet does not interfere with intricate dance maneuvers such as brisé, entrechat quatre and the like that a dancer must perform. The dancer simply puts the inventive augmentation pad on before his or her tights and then performs as usual. The pad is so comfortable and subtle that dancers forget they are wearing it.

Another advantage of the present invention is that it can be used with a wide variety of commercially available dance shoes. The inventive pad of the present invention conveniently tucks under the border of many available dance shoes and in some shoes is in part concealed by the dance shoe's ribbon. The effect is that the dancer's foot appears more like a desirable "banana foot."

Yet another advantage of the present invention is its cost. The pad of the present invention can be simply and cost-effectively manufactured from a variety of suitable materials.

Still another advantage of the present invention is that it may afford career opportunities to a dancer with outstanding dance abilities but uncomely feet. By improving the aesthetic appearance of a dancer's feet, the present invention can remove a significant obstacle to gaining entrance into a dance school or gaining a part in a performance. A dancer using the present invention can compete with dancers who were naturally endowed with more aesthetically pleasing feet.

BRIEF DESCRIPTION OF DRAWINGS

The above-mentioned and other advantages of the present invention, and the manner of obtaining them, will become more apparent and the invention itself will be better understood by reference to the following description of the embodiments of the invention taken in conjunction with the accompanying drawings, wherein.

Corresponding reference characters indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1A:
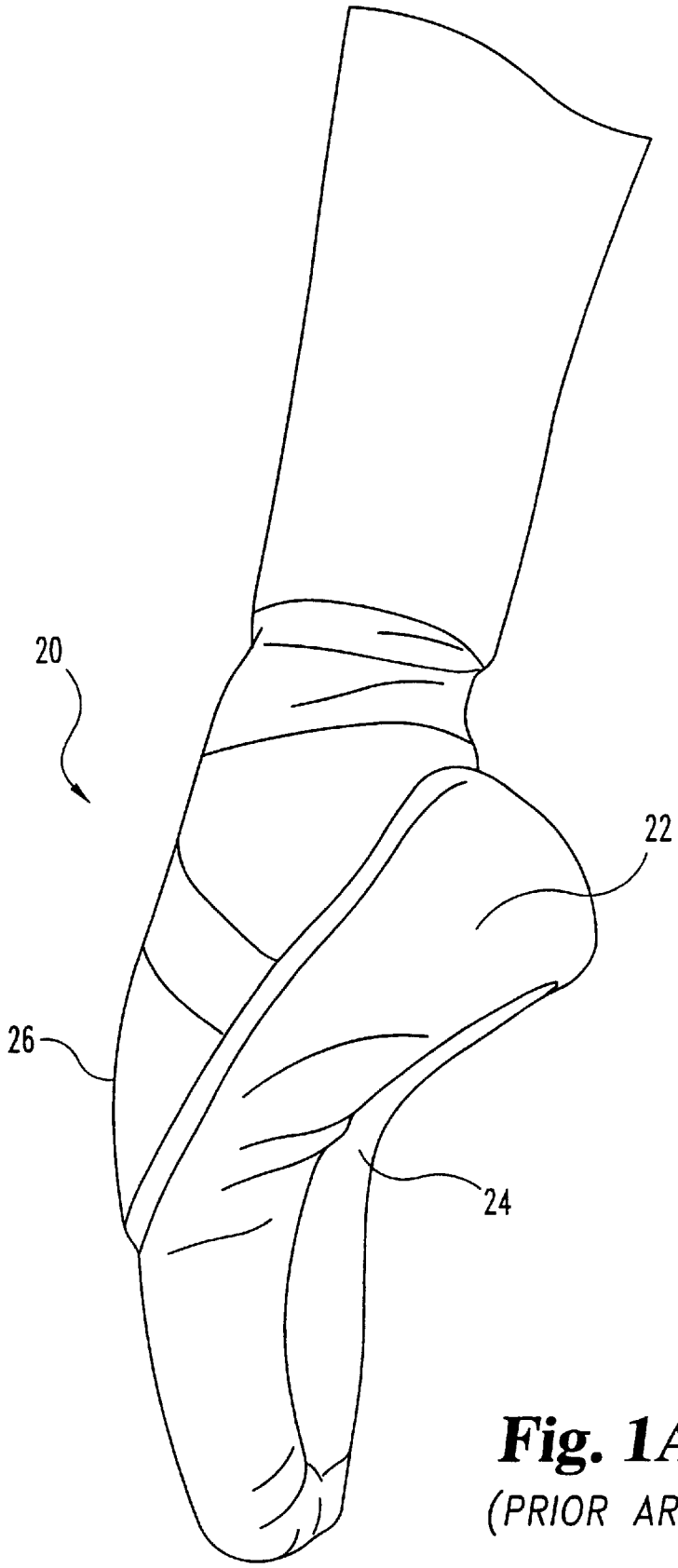
Fig. 1A (PRIOR ART)
FIG. 1A is a perspective view of a classically shaped dancer's foot wearing a traditional pointe shoe.
Figure 1B:
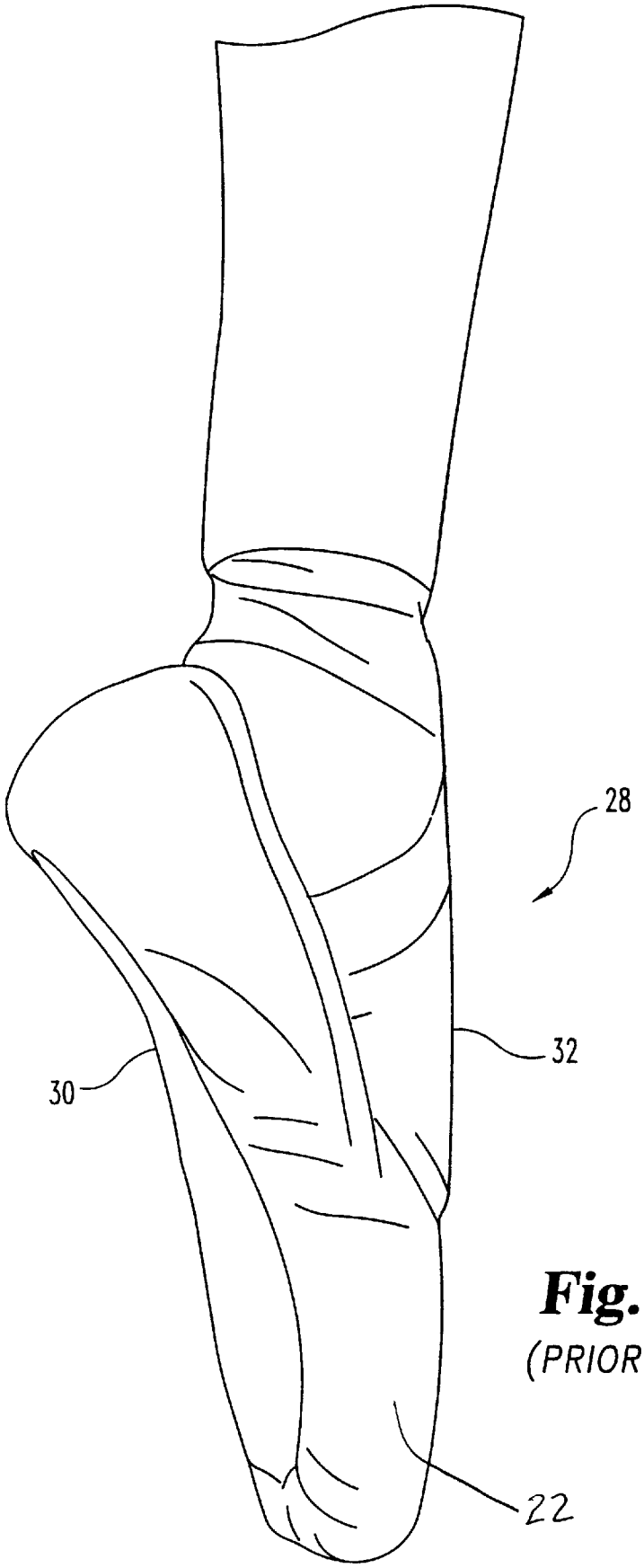
Fig. 1B (PRIOR ART)
FIG. 1B is a perspective view of a dancer's foot that lacks some of the aesthetically pleasing qualities of the foot depicted in FIG. 1A, but is shown wearing the same pointe shoe as depicted in FIG. 1A.

Referring now to FIG. 1A, a dancer's foot 20 is depicted wearing a pointe shoe 22. As can be seen, the dancer's arch 24 is pronounced and aesthetically pleasing. Furthermore, the dancer's instep 26 or top of the foot is also well-rounded and is therefore aesthetically pleasing. In stark contrast to the foot 20 depicted in FIG. 1A, foot 28 shown in FIG. 1B would not be generally regarded as aesthetically pleasing, even though foot 28 is shown wearing the same pointe shoe 22 as in FIG. 1A. Foot 28 has a poor or flat arch 30 and a substantially flat instep 32. The opportunities for the dancer possessing foot 28 would probably be much more limited than the opportunities presented to the dancer possessing foot 20, even assuming their respective dance abilities were equivalent.

Figure 1C:
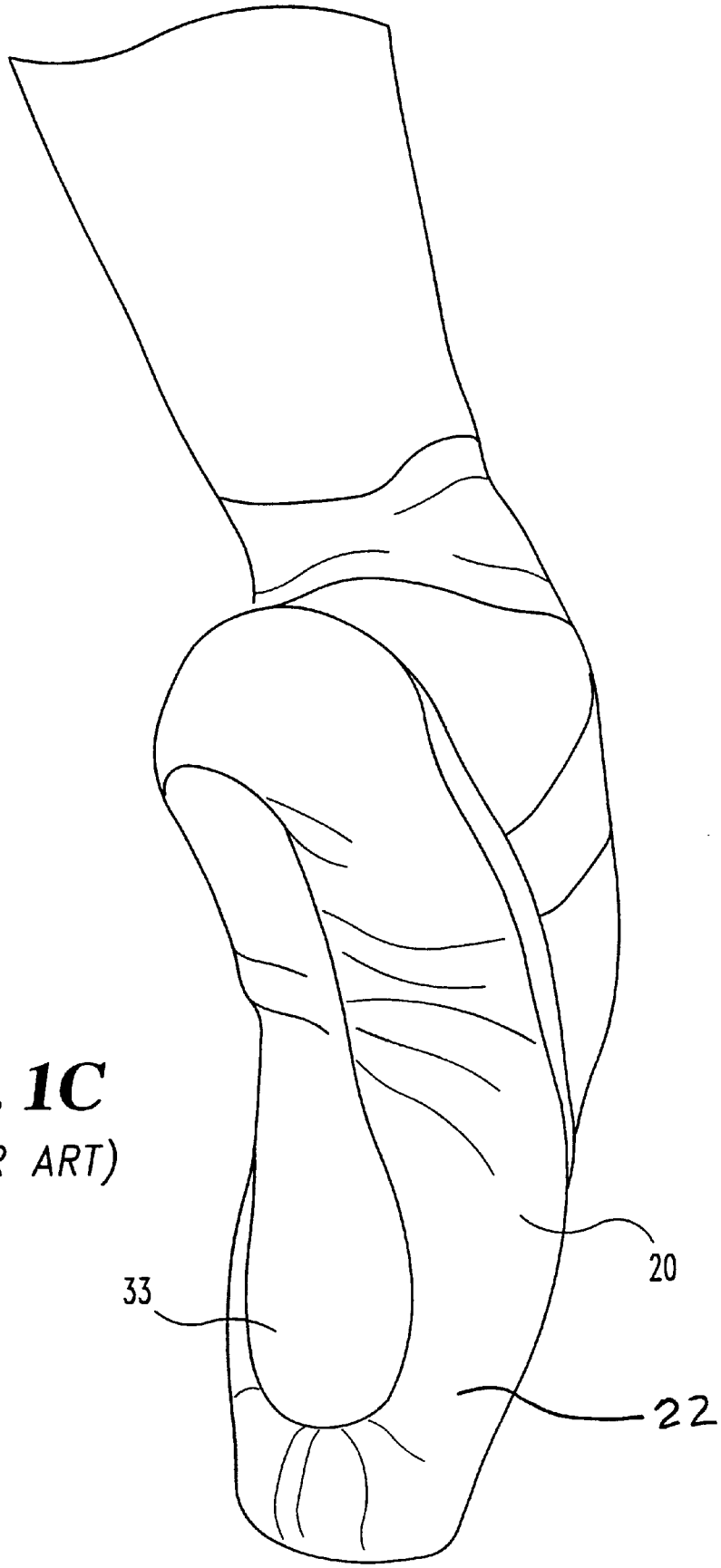
Fig. 1C (PRIOR ART)
FIG. 1C is a perspective view of the dancer's foot of FIG. 1A with the foot in a different position and illustrating the sole of the foot and shoe.
Figure 1D:
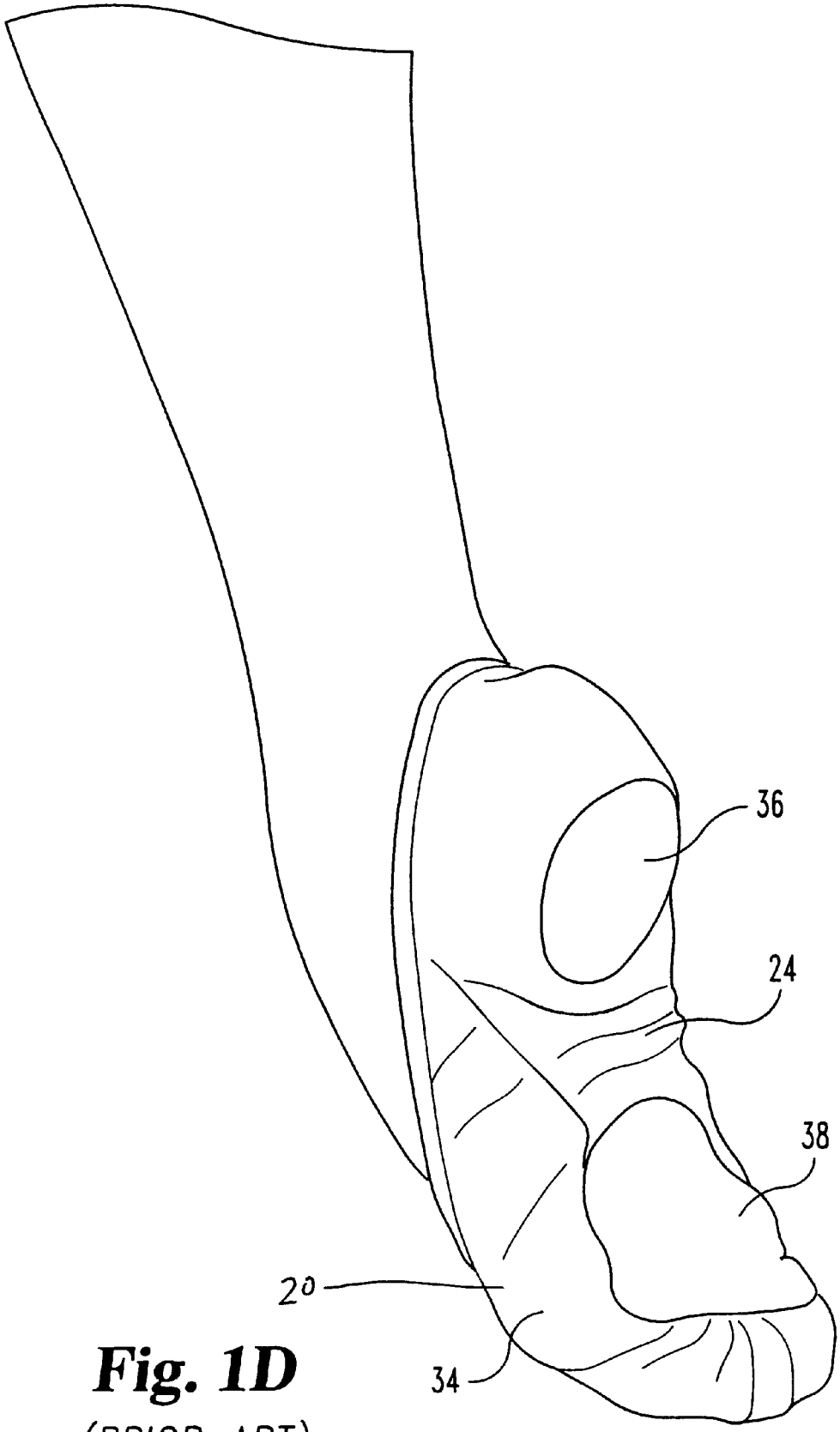
Fig. 1D (PRIOR ART)
FIG. 1D is a perspective view of a dancer's foot shown wearing a ballet slipper.

As shown in FIG. 1C, pointe shoe 22 has sole 33 that substantially conforms to the bottom of the dancer's foot. In FIG. 1D dance shoe 34 has bifurcated soles 36 and 38 such that the fabric of shoe 34 substantially conforms to arch 24. With any of these prior art dance shoes, the shape of the bottom of the foot will be seen by the audience watching the dancer because the bottom of the dance shoe substantially conforms to the bottom of the dancer's foot. If the foot be aesthetically pleasing, this is desirable. On the other hand, if the dancer's foot is flat or otherwise unattractive, the dance shoe will reveal it.

It is to be understood that the term "dance shoe" is to be construed broadly to cover pointe shoes, soft shoes and other shoes worn in dance wherein the top or instep of the foot is substantially uncovered. It is also to be understood that the term "dance routine" as used herein is to be construed broadly, ranging from an entire performance to single dance maneuvers, such as brisé, entrechat quatre and the like.

Figure 2:
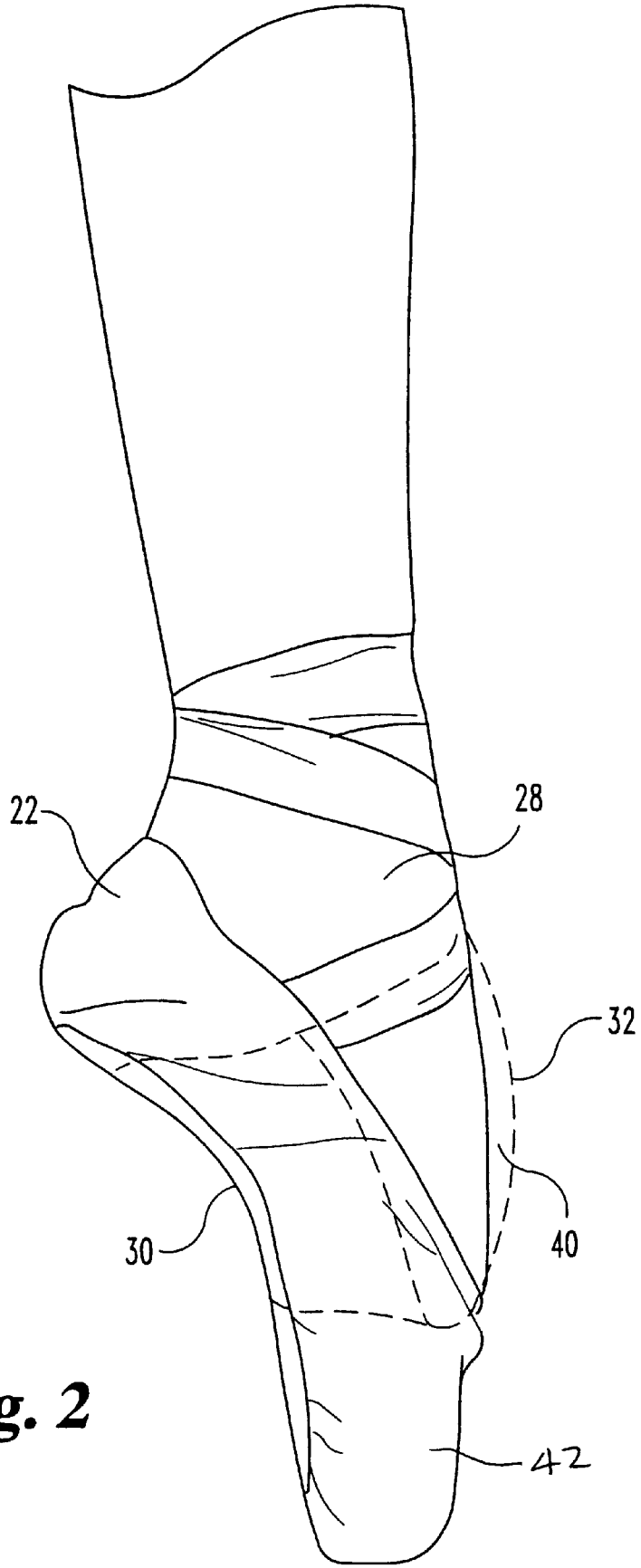
FIG. 2 is a perspective view of a dancer's foot shown wearing a pointe shoe and illustrating in phantom lines the pad in accordance with the present invention.
Figure 2A:
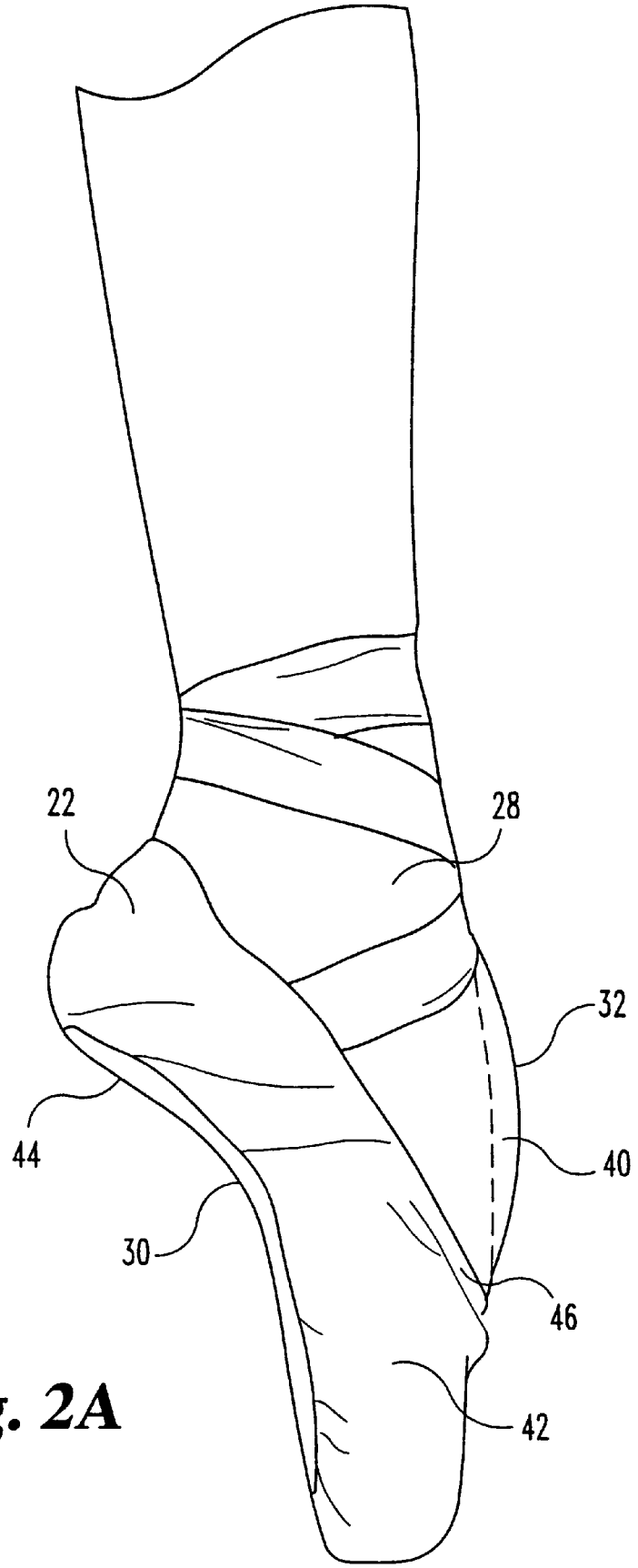
FIG. 2A is a perspective view of the dancer's foot of FIG. 2 illustrating in phantom the actual profile of the dancer's foot.

Turning now to FIG. 2 and FIG. 2A, it has been found that the appearance of a dancer's foot 28 wearing pointe shoe 22 may be enhanced by attaching a pad 40 of the present invention to the top or instep of the foot. FIGS. 2 and 2A depict the dancer's foot in the pointe position, the familiar ballet position in which the body is balanced on the extreme tips of the toes. For purposes of this specification, the term "attached" and derivatives thereof when used in connection with pad 40 is to be construed broadly to cover any means or method of substantially fixing in place or adhering pad 40 against the foot. As shown in FIGS. 2 and 2A, instep 32 has been actually physically augmented by pad 40. Surprisingly, however, it has been found in practice that the appearance of arch 30 has also been enhanced, even though no augmentation had been performed directly upon arch 30. It is believed that the enhanced appearance of arch 30 is achieved by the "mind's eye" viewing the entire foot as a composite and thus incorporating the augmentation of instep 32 into arch 30.

Figure 3:
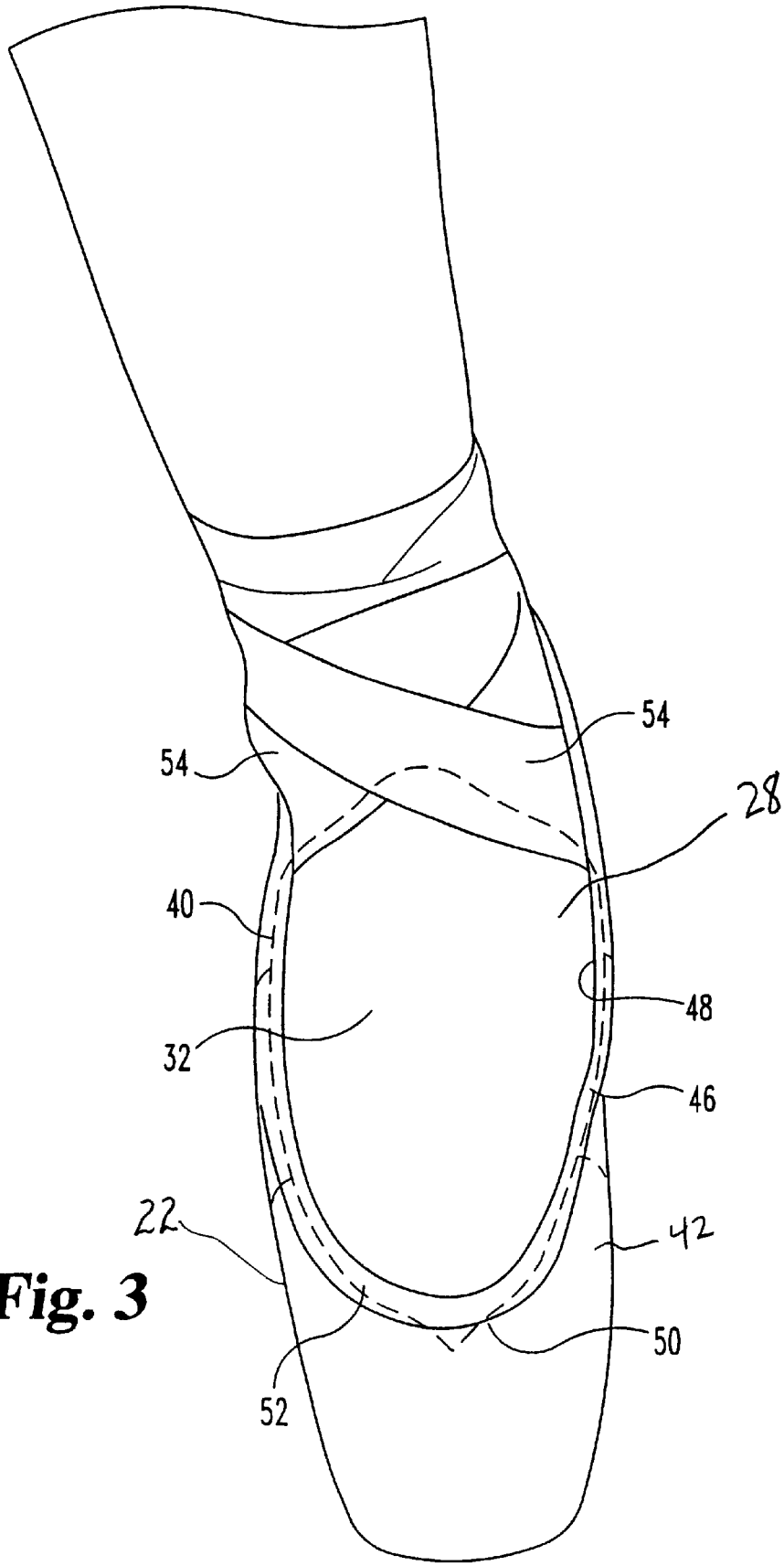
FIG. 3 is a perspective of a dancer's foot wearing a pointe shoe taken from above and illustrating the pad in accordance with the present invention in phantom.

As shown in FIGS. 2 and 2A and more particularly in FIG. 3, pointe shoe 22 includes a fabric material 42, preferably satin, which is adapted to partially cover foot 28. A flexible sole 44 made preferably from leather is typically sewn or glued on the bottom of fabric material 42, as is known in the art. As mentioned above, sole 44 conforms to the shape of the arch 30 of the foot and provides little or no support therefor, such that the true shape of the arch is revealed. A shank is provided in the inside of shoe 22 (not shown), but such shank provides little support. Fabric material 42 terminates in a border 46 which further defines an open top 48 adapted to substantially expose the top or instep 32 of foot 28, as is seen in FIG. 3. Border 46 can be formed of a piece of fabric sewn around the periphery of opening 48. As shown in FIG. 3, border 46 defines a vamp 50 that covers the toes of the foot.

Pad 40 is formed of a resilient and deformable material that is sized to cover the top or instep 32 of foot 28. Pad 40 has an outer periphery or edge portion 52 that is concealed under border 46, which makes the existence of pad 40 difficult to detect. Preferably, edge portion 52 is covered at least in part by ribbons 54, thereby further concealing the existence of pad 40. Optionally, edge portion 52 of pad 40 can be sewn into border 46 of pointe shoe 22 (not shown). Typically, however, pad 40 is formed separate from shoe 22 such that pad 40 can be used with a variety of commercially available shoes.

Figure 4:
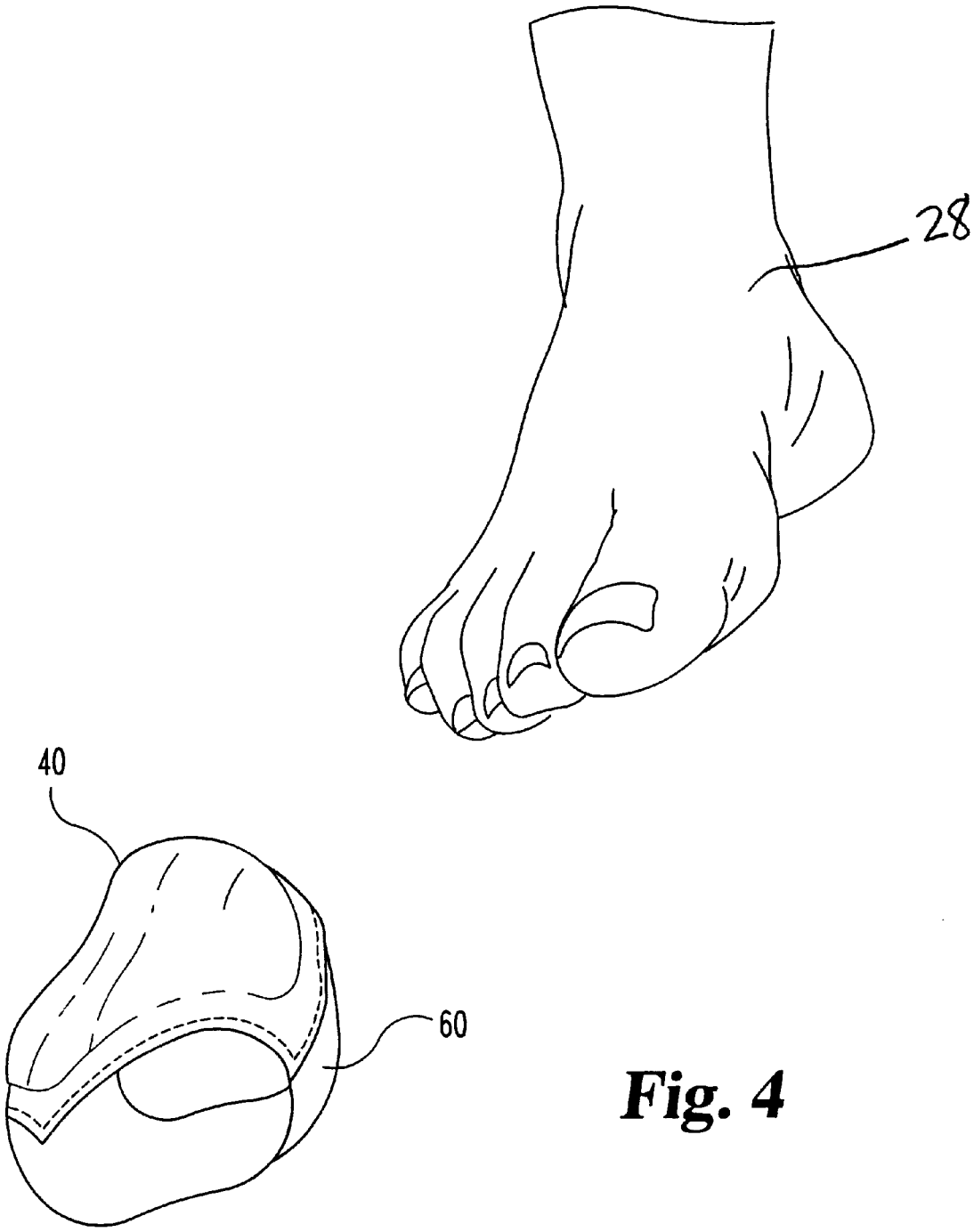
FIG. 4 is a perspective view showing a pad in accordance with the present invention removed from a dancer's foot.
Figure 5:
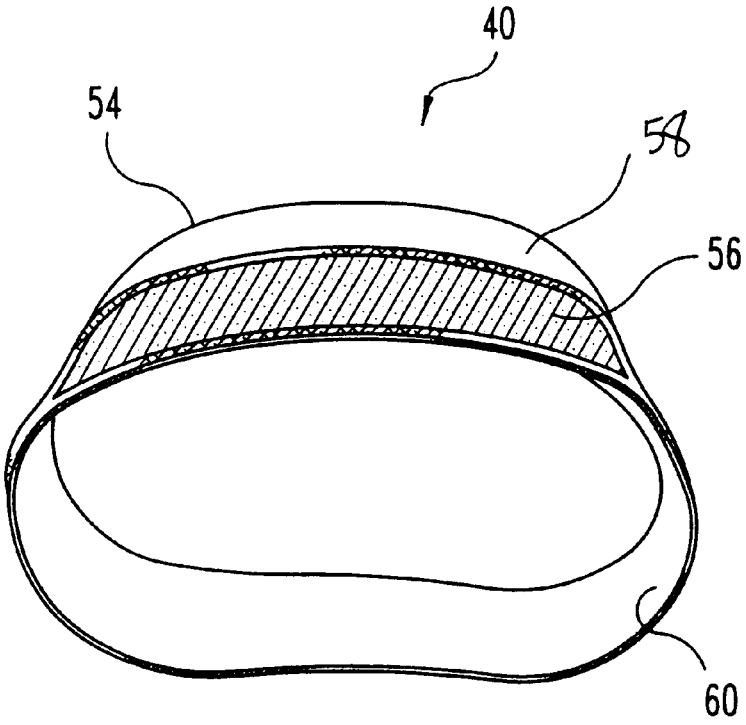
FIG. 5 is a plan view in partial cross section showing a pad in accordance with the present invention.

As shown in FIGS. 4 and 5, pad 40 includes a foam or other material 56 encased or sewn into a fabric 58, which is preferably of skin color to conceal the existence of pad 40. The material 56 must be flexible and resilient, conforming to the dancer's foot, maintaining its shape, but not interfering with the dancer's intricate movements, such as brisé, entrechat quatre and the like. Material 56 should be of light weight. Many suitable materials can be used for insert 56, such as foam having a wide variety of density, resilient polymers, open celled polymers, gel-pads, visco-elastic materials, conventional stuffings such as hair or feathers, and many other suitable materials. Optionally, pad 40 can be formed of a unitary material, thereby obviating fabric 58. Pad 40 should be soft, lightweight, resilient, flexible and preferably washable. As shown in FIG. 5, material 56 and thus pad 40 gradually taper in a direction outwardly from the center. The taper occurs both front and back as well as side to side. The tapering thickness provides the appearance of curvature to the top of the foot that is otherwise lacking, and also makes the bottom or arch of the foot appear more pronounced.

Surprisingly, a "bubble effect" has been observed by virtue of the border 52 pressing down on pad 40 around its edges. That is to say, the curvature or roundness of the exposed part of pad 40 becomes more pronounced when the edges of pad 40 are pressed by border 52. This enhances the aesthetically pleasing look of the dancer's foot.

Figure 7:
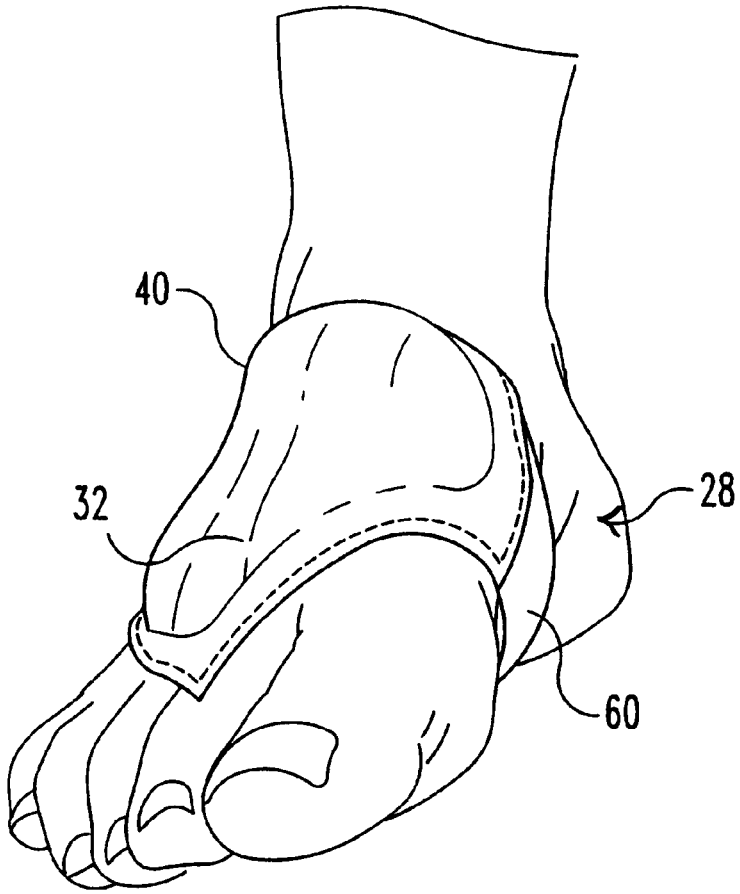
FIGS. 7–9 are perspective views illustrating a method of assembling a dance outfit in accordance with the present invention.

Pad 40 also preferably includes an elastic band 60 which is placed around the foot and holds pad 40 in place as shown in FIG. 7. Band 60 can be made of elastic or other suitable stretchable material. It has been found that band 60 should be of substantially the same width as the pad, itself. A wide band 60 helps keep pad 40 in place while the dancer is performing.

Figure 6A:
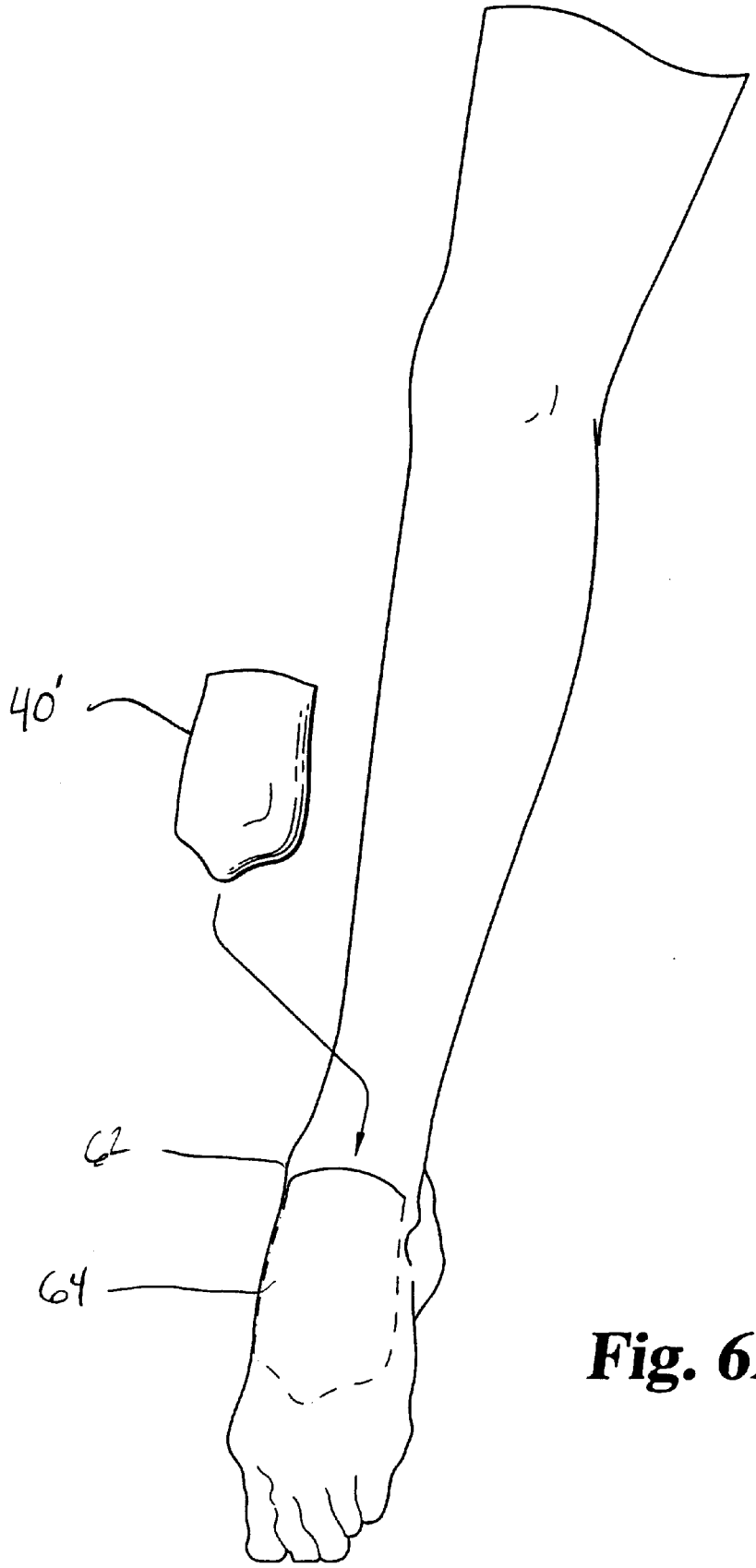
FIG. 6A is a perspective view of a dancer wearing tights having a pocket for receipt of a pad in accordance with the present invention.
Figure 6B:
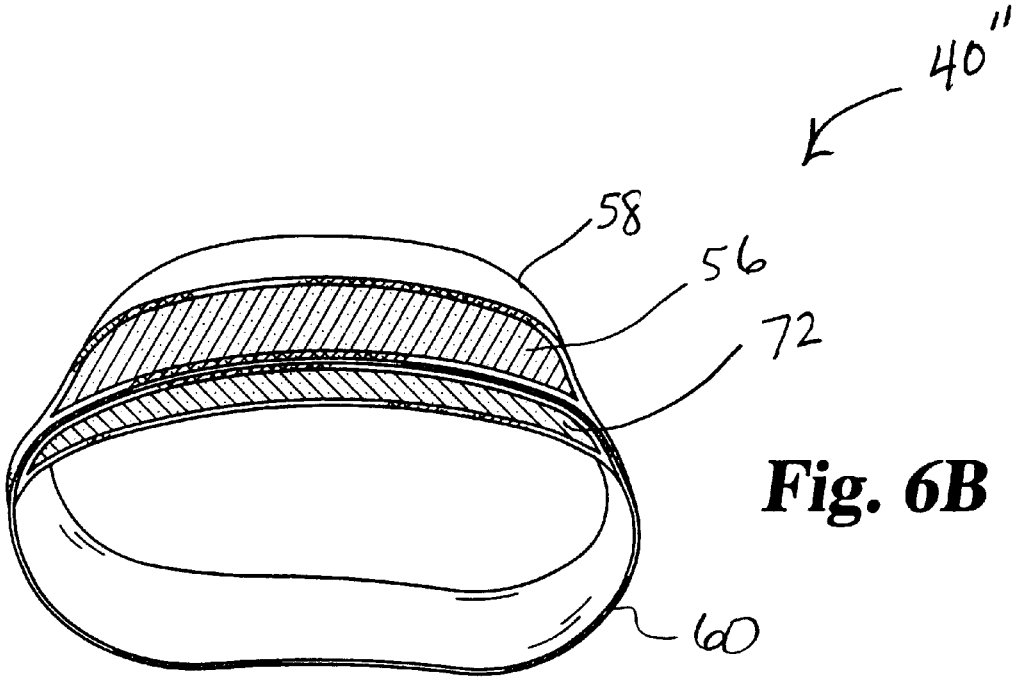
FIG. 6B is a perspective view in partial cross section illustrating an alternate embodiment of a pad in accordance with the present invention.

As shown in FIG. 6A, tight 62 can be formed with a pocket 64 into which pad 40' can be inserted. In this embodiment, the necessity for an elastic band 60 is obviated. Also, as mentioned above, the pad may be attached to the dance shoe by sewing it to the border thereof (not shown), although this method would have the disadvantage of not allowing the tight to cover the pad and conceal it and is therefore not preferred. FIG. 6B illustrates yet another embodiment of the present invention wherein pad 40" includes a second soft material 72 underneath elastic band 60. Material 72 can be comprised of the same composition as material 56 or may be an alternate material. Material 72 can be useful in cases where extra padding is necessary for the augmentation.

Figure 6C:
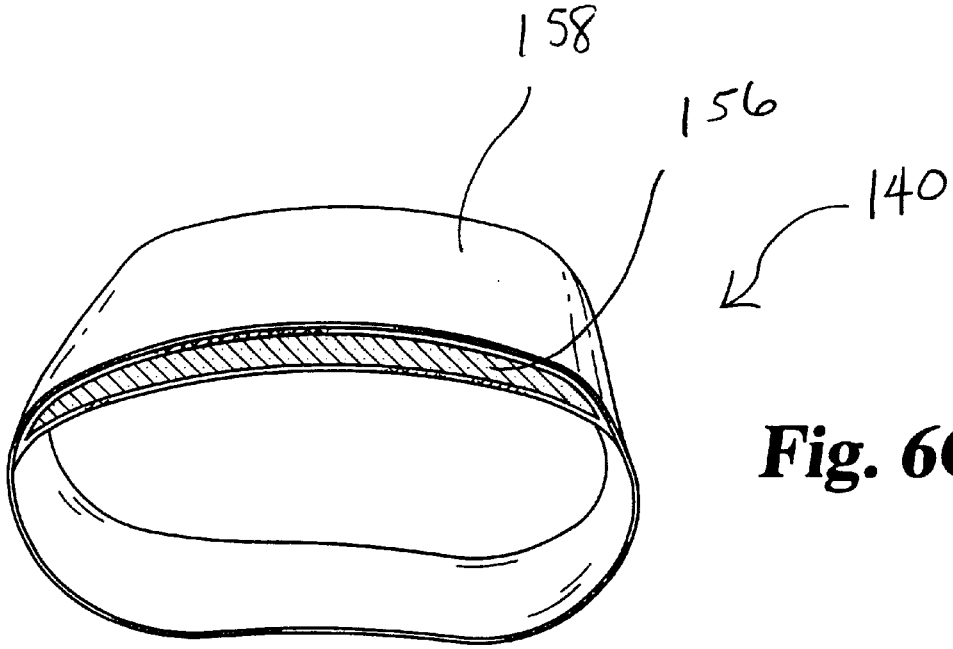
FIG. 6C is a perspective view in partial cross section illustrating an alternate embodiment of a pad in accordance with the present invention.
Figure 6D:
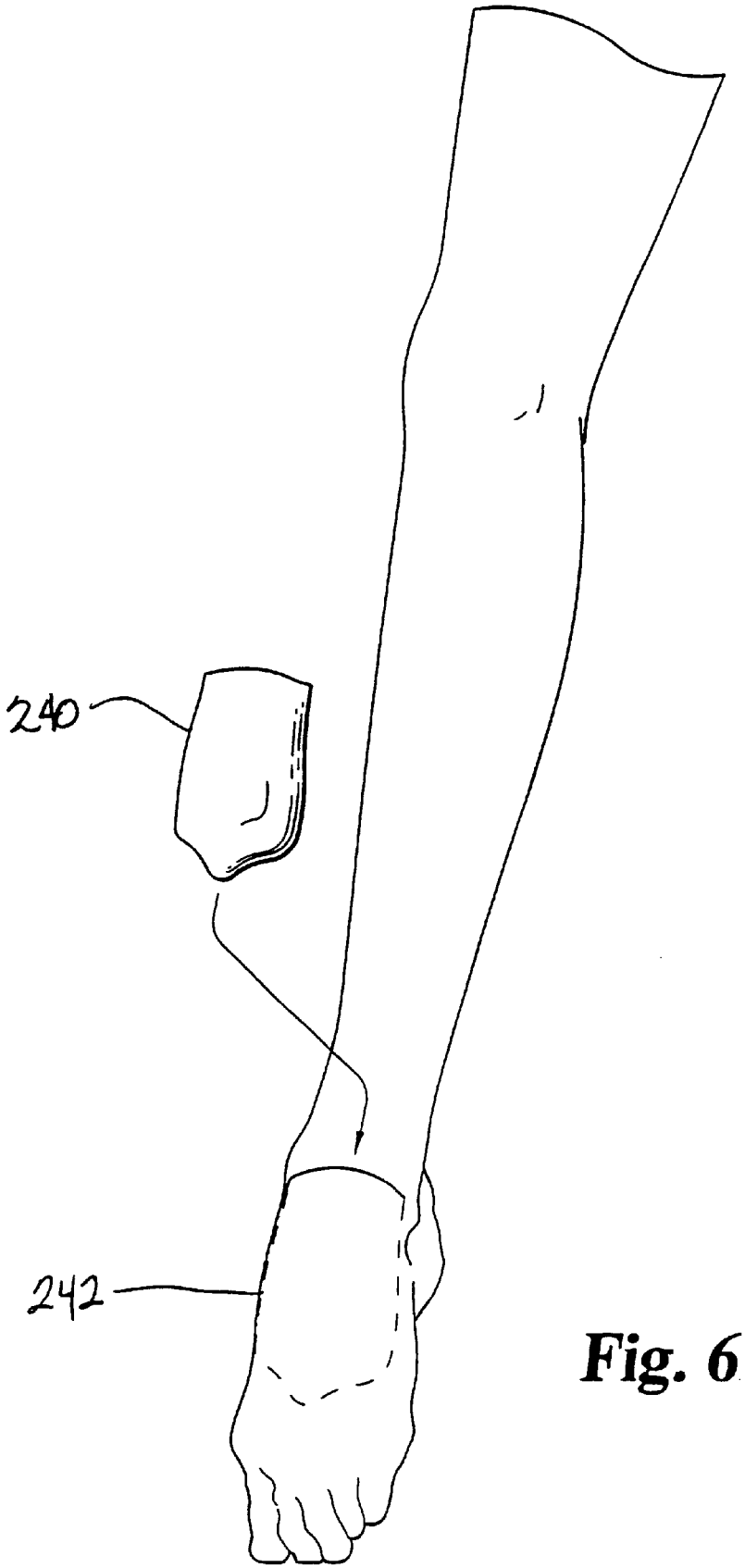
FIG. 6D is a perspective view of a dancer wearing a pad which adheres directly to the skin in accordance with the present invention.

FIG. 6C illustrates a pad 140 wherein insert material 156 is separate from fabric 158 such that material 156 can be easily removed and replaced with a different size material or material of a different composition. FIG. 6D illustrates a pad 240 that adheres directly to the skin in the area of dashed line 242 such that a band such as band 60 is not necessary. It is envisioned that certain polymers have inherently adhesive qualities such that further adhesives are not necessary to maintain pad 240 against the foot while dancing. Alternatively, pad 240 can be adhered with any of a variety of adhesives that are well known in the art. Pad 240 can be formed of a clear or translucent material.

Figure 8:
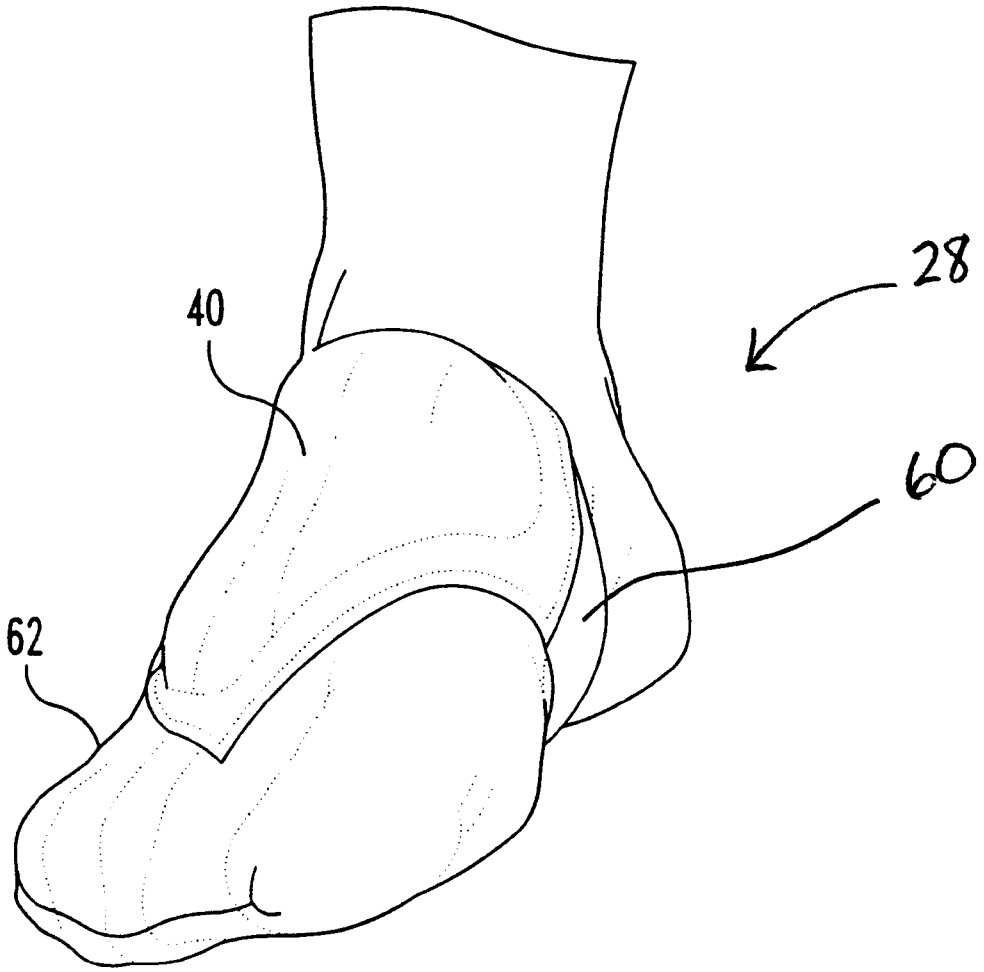
Figure 9:
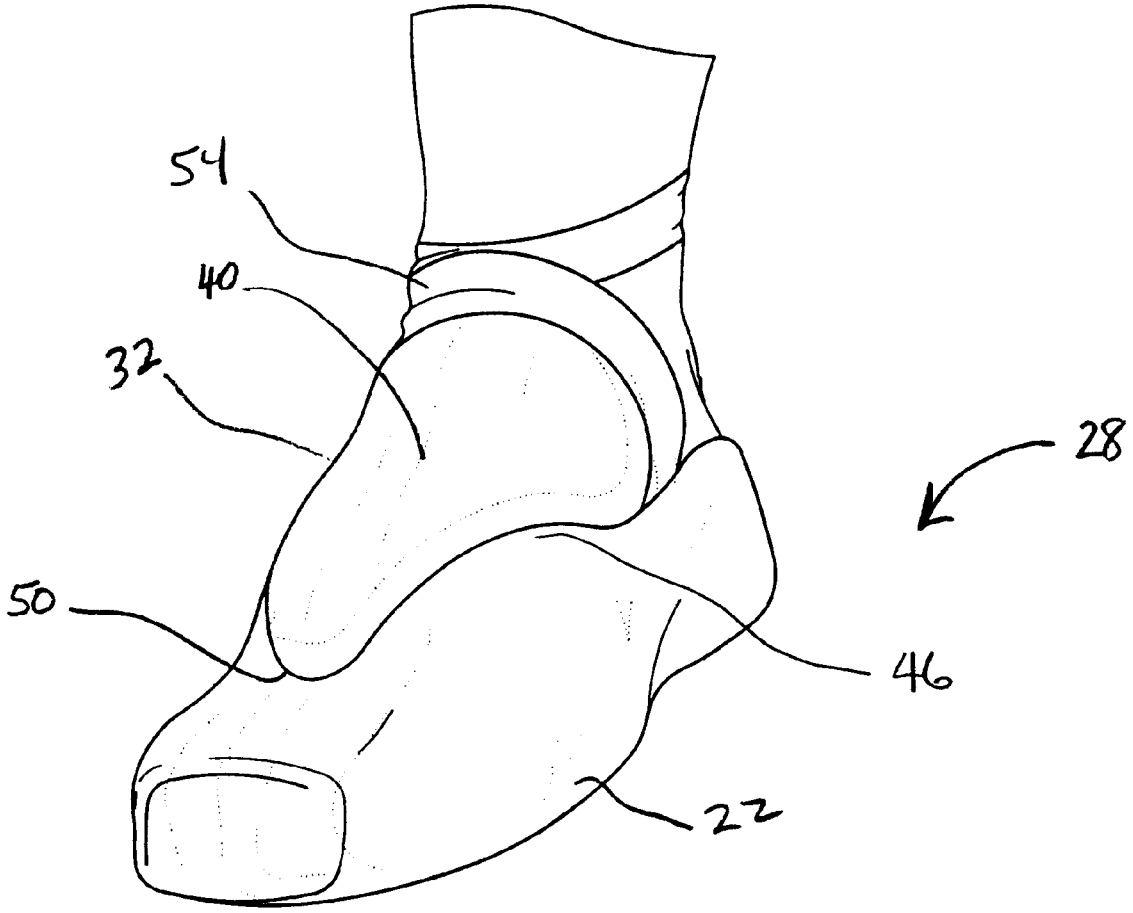

FIGS. 7–9 illustrate one method in accordance with the present invention of assembling or wearing a dance outfit to augment the appearance of the dancer's foot. In FIG. 7, pad 40 is attached to foot 28 by stretching elastic band 60 and pulling pad 40 into the desired location on foot 28. Thus, a substantial portion of the instep 32 of foot 28 is covered with pad 40. Next, with reference to FIG. 8, a dancer's tight 62 is pulled over over the dancer's leg and thus pad 40, whereby pad 40 is concealed by tight 62. Finally, with reference to FIG. 9, a dance shoe 22 having a substantially open top is placed on foot 28 over tight 62 such that pad 40 is substantially or totally uncovered by dance shoe 22. Thus, the thickness of pad 40 enhances the appearance of the top and bottom of the dancer's foot, but pad 40 is invisible to the observer who is unaware of its presence. As noted with reference to FIG. 3, the edge of pad 40 is preferably covered with border 46 of the shoe and with the ribbons 54, further concealing the pad. To help conceal the pad, its color can be a skin color such as beige, tan, brown, bronze, etc.

Figure 10:
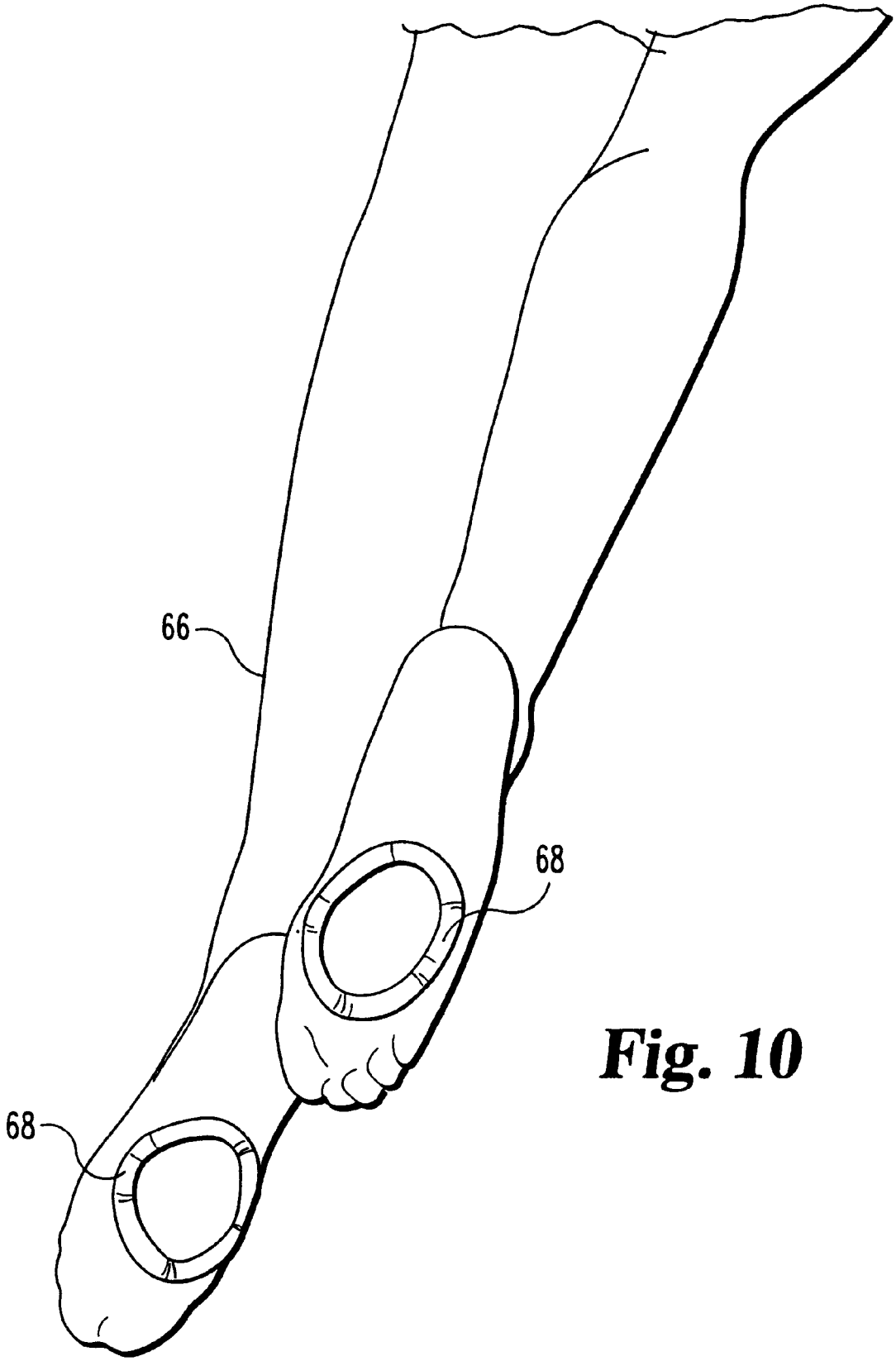
FIGS. 10–13 are perspective views illustrating an alternate method of assembling a dance outfit in accordance with the present invention with a convertible tight.
Figure 11:
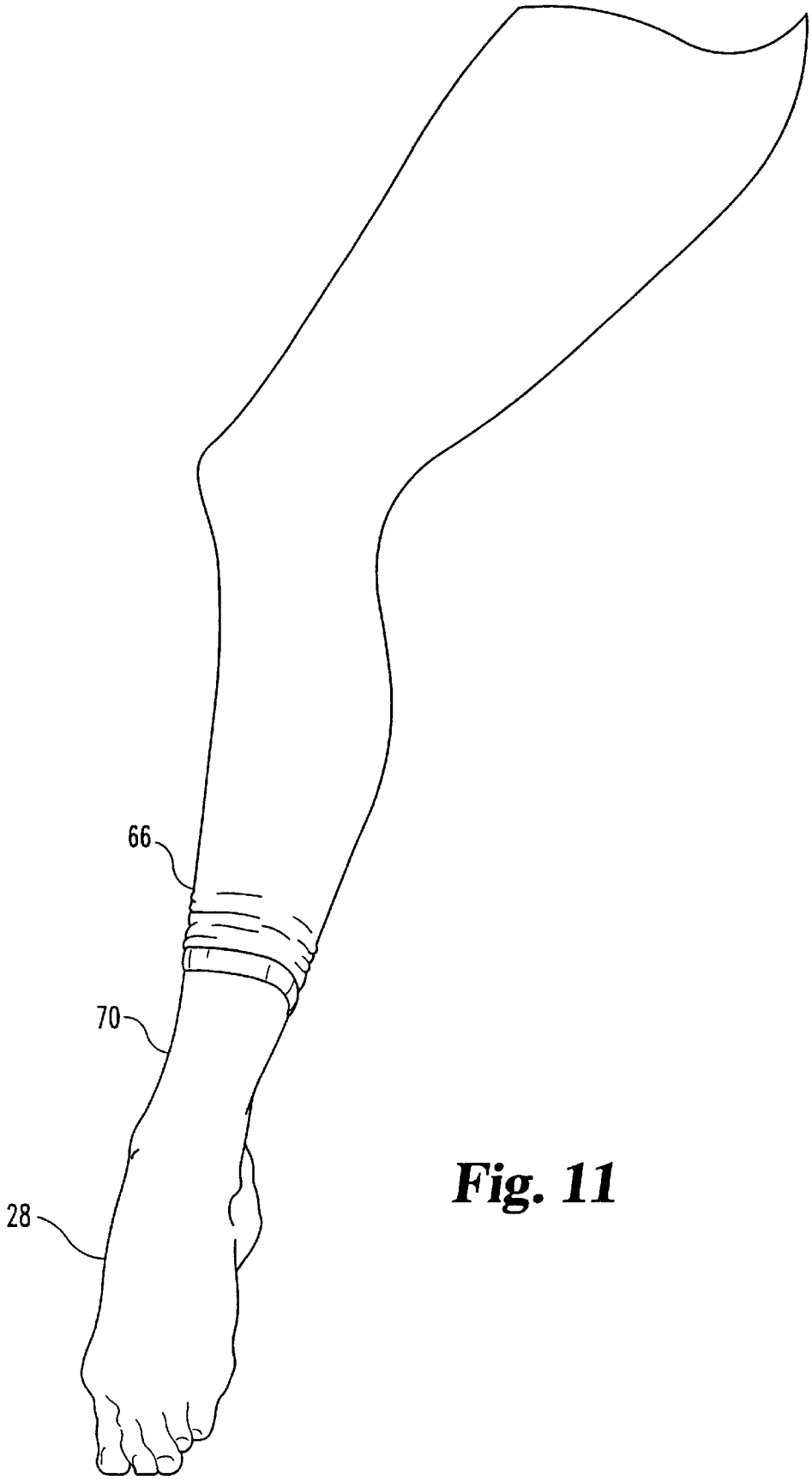
Figure 12:
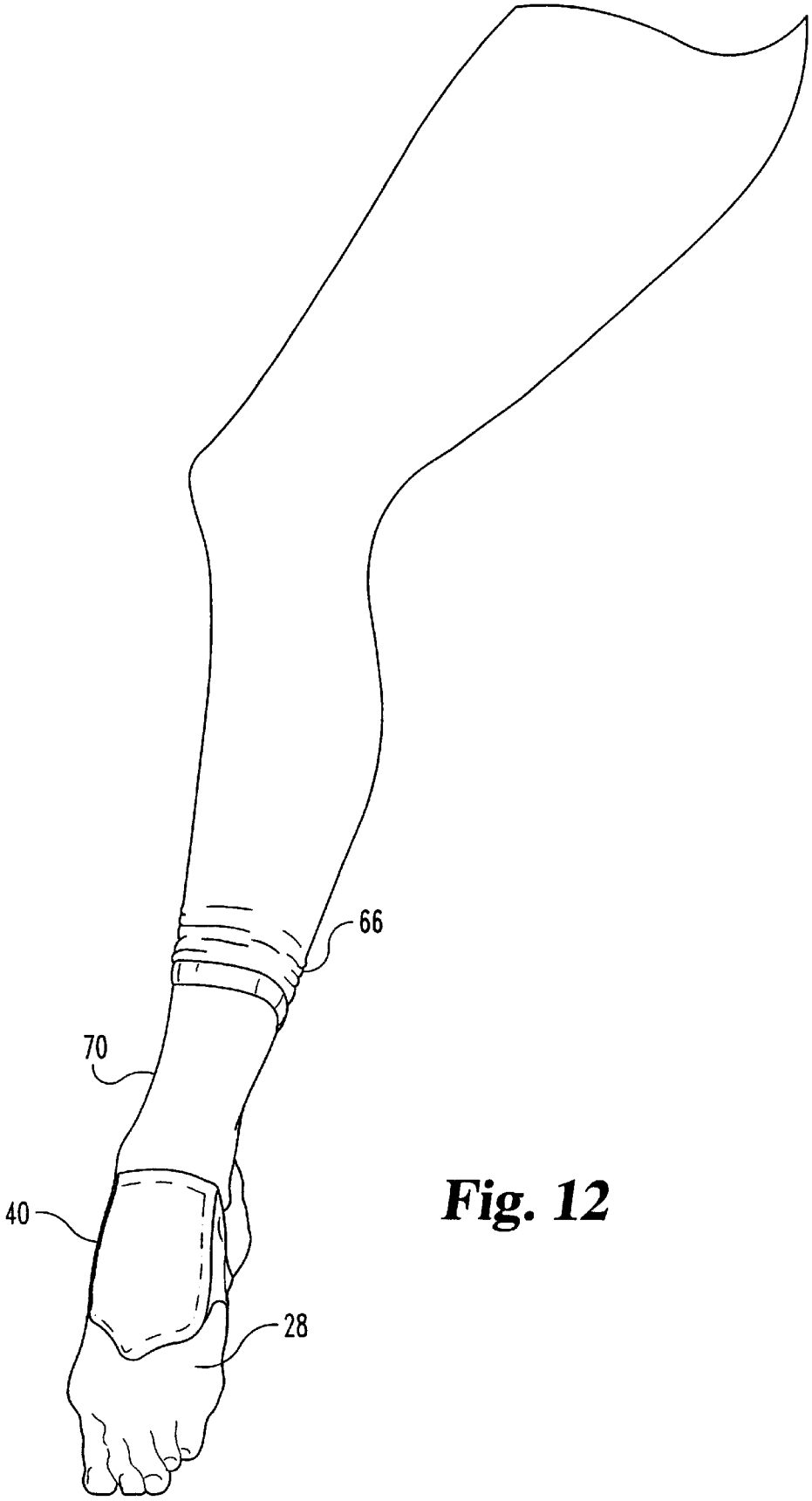
Figure 13:
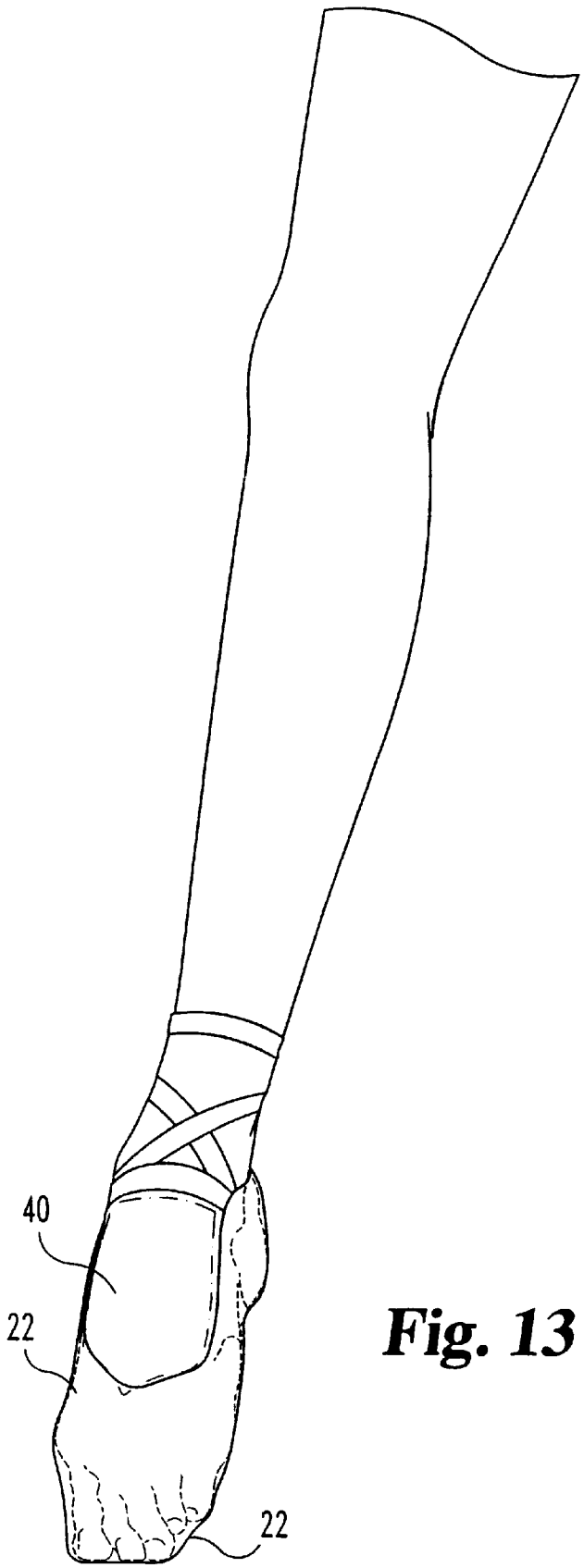

FIGS. 10–12 illustrate a method of assembling a dance uniform with a convertible tight 66 having openings 68 on the bottom thereof such that tight 66 can be donned prior to placing pad 40 on foot 28. As shown in FIG. 11, tight 66 is rolled up around the ankle 70 such that pad 40 can then be placed on foot 28 as shown in FIG. 12. After, pad 40 is in place on foot 28, tight 66 is pulled back over foot 28 and shoe 22 is then put on foot 28 as shown in FIG. 13.

Once the inventive dance outfit including a pad in accordance with the present invention is assembled, the dancer may perform her dance routine in confidence that her feet appear aesthetically pleasing, yet the enhancement is concealed from the audience.

While a preferred embodiment incorporating the principles of the present invention has been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In combination:

a dance shoe, comprising a fabric material adapted to partially cover the foot of its wearer, a flexible sole disposed on the bottom of the fabric adapted to conform to the shape of the arch of the foot, said fabric material terminating in a border which further defines an open top of said shoe and which is adapted to substantially expose the top of the foot, said border defining a vamp adapted to cover the toes of the foot; and a resilient and deformable augmentation pad sized to substantially cover the top of the foot that is exposed by said open top, said pad thereby occupying a portion of the space defined by said open top and having an edge portion tucked under said border of said dance shoe and removable therefrom, said edge portion thereby concealed under said border of said dance shoe, whereby, when worn, said pad is substantially uncovered by said shoe, said pad covers the top of the foot, extending from said vamp and approaching the ankle, and the shape and thickness of said pad augments the appearance of the top and bottom of the foot.

2. The combination of claim 1, wherein said dance shoe further comprises a ribbon which is adapted to conceal part of said edge portion of said pad.

3. The combination of claim 1, wherein said pad gradually tapers in thickness from its center to said edge portion.

4. The combination of claim 1, wherein said pad is comprised of foam.

5. The combination of claim 4, wherein a cloth material encases said foam.

6. The combination of claim 1, wherein said pad has a skin colored exterior.

7. The combination of claim 1, wherein said pad comprises a stretchable band adapted to be placed around the foot and hold said pad in place.

8. The combination of claim 1, wherein a top surface of said pad comprises a curved shape and said pad has a maximum thickness substantially at its center.

9. A method of wearing a dance outfit to augment the appearance of a dancer's foot, said method comprising:

(a) covering a portion of the top of the foot with an augmentation pad;

(b) donning a tight over the augmentation pad, whereby the augmentation pad is concealed by the tight; and (c) fitting a dance shoe having a substantially open top over the tight, the augmentation pad being substantially or totally uncovered by the dance shoe and covered by the tight, the pad occupying a portion of the space defined by the open top, wherein the top surface of the pad defines what appears to be the top profile of the dancer's foot which is exposed by the dance shoe and further wherein the pad accentuates the curvature of the exposed profile of the dancer's foot, whereby the pad enhances the appearance of the top and bottom of the dancer's foot.

10. The method of claim 9, further comprising covering an edge portion of the pad with a border of the shoe.

11. The method of claim 10, further comprising covering a second edge portion of the pad with a ribbon of the shoe.

12. The method of claim 9, further comprising substantially matching the color of the pad with the color of the dancer's skin.

13. The method of claim 9, wherein the pad tapers in thickness in a direction away from its center.

14. The method of claim 9, wherein step (a) comprises placing around the foot a stretchable band that is attached to the pad.

15. The method of claim 9, wherein the pad is formed of a deformable material having a maximum thickness toward its center.

16. The method of claim 9, wherein the pad has a curved exposed surface, whereby the appearance of the instep and arch is augmented.

* * * * *